US005484144A

United States Patent [19]

St. Onge

[11] Patent Number: 5,484,144

[45] Date of Patent: * Jan. 16, 1996

[54] TRANSPORTABLE BASKETBALL NET ASSEMBLY FOR TEMPORARY USE ON A BASKETBALL RIM

[76] Inventor: Matthew R. St. Onge, 6-12 Louisburg Square, Nashua, N.H. 03060

[ * ] Notice: The portion of the term of this patent subsequent to Apr. 11, 2012, has been disclaimed.

[21] Appl. No.: 289,186

[22] Filed: Aug. 11, 1994

Related U.S. Application Data

[63] Continuation-in-part of Ser. No. 218,310, Mar. 25, 1994, Pat. No. 5,405,132.

[51] Int. Cl.[6] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 4,082,269 | 4/1978 | Hill | 273/1.5 R |
| 4,805,903 | 2/1989 | McArdle | 273/1.5 R |
| 4,834,368 | 5/1989 | Qualley | 273/1.5 R |
| 4,903,964 | 2/1990 | Anderson | 273/1.5 R |
| 4,905,995 | 3/1990 | Apo | 273/1.5 R |
| 5,098,091 | 3/1992 | McGivern | 273/1.5 R |
| 5,123,642 | 6/1992 | Stokes | 273/1.5 R |
| 5,195,742 | 3/1993 | Bailey | 273/1.5 R |

*Primary Examiner*—Paul E. Shapiro

*Attorney, Agent, or Firm*—Daniel J. Bourque; Kevin J. Carroll; David D. Lowry

[57] ABSTRACT

A transportable basketball net assembly for temporary use on a basketball rim, installed from the ground using only the basketball. Installation is accomplished by gathering and holding the net material to one side to close the lower end of the net, inverting and disposing the net assembly over the basketball, then throwing the ball and net assembly into position on the basketball rim, the net then falling open under the weight of the falling ball. The net assembly is dislodged and removed by throwing the ball up through the rim, contacting the net and the flanged collar with upward force from below.

20 Claims, 6 Drawing Sheets

TRANSPORTABLE BASKETBALL NET ASSEMBLY FOR TEMPORARY USE ON A BASKETBALL RIM

This is a continuation-in-part of U.S. patent application Ser. No. 08/218,310 filed on Mar. 15, 1994, now U.S. Pat. No. 5,405,132.

BACKGROUND OF THE INVENTION

FIELD OF THE INVENTION

This invention most generally relates to games and other activities employing netted hoops or netted rims or other netted openings through or into which balls or other objects are dropped, thrown or otherwise passed.

More specifically, it relates to the sport of basketball and to the basketball goal assembly. The goal assembly is a backboard mounted in a vertical plane high over the basketball court to which a circular rim of approximately twice the diameter of a basketball is firmly attached in a horizontal plane. At evenly spaced intervals around the rim, the large open end of a net is attached, the net having a smaller opposite open end through which a basketball may readily pass. The rim and net assembly is often referred to as a "hoop." The object of the game, in the general sense, is to throw, drop or otherwise pass the basketball down through the hoop.

It is commonly known to affectionados of the sport that a hoop or rim without a net does not affect the motion of the basketball in the same manner as a hoop or rim with a net. Likewise, a hoop or rim with a torn or damaged net does not affect the motion of the basketball in the desired manner. It is very important to the players and spectators, then, that the hoop or rim be properly equipped with a net in good condition. It is incumbent upon managers of such facilities to make it so, and keep it so, if their goal is to attract users and spectators to the facility.

The conventional basketball rim is made of metal. The conventional means of attaching a net to the rim is by means of twelve wire loops uniformally positioned and welded to the lower edge of the rim. The rim is generally permanently installed about ten feet above the floor of the basketball court, making it inconvenient, time-consuming, difficult, and potentially dangerous to install or change a net. It is therefore properly and commonly the province of the facilities manager to maintain the court, including the net, and to have and use the ladders and other necessary tools required to do so. It is equally common that new nets and the necessary tools to install it will be secured and unavailable for immediate access by most casual users and potential users of the basketball court.

It is the further misfortune of these casual users and potential users that the basketball net, once installed, is then often neglected for an extended period when a net is worn, damaged or missing, until the facilities manager is faced with a compelling reason to replace it. In public-use installations, vandalism may be a further factor in the frequency of damaged and missing nets. On outdoor courts, the weather is a further major factor in the deterioration of basketball nets. The result is that many courts are left only marginally attractive for the playing of basketball due to the worn, damaged, or missing net problem.

There is yet a further problem with the use of nets attached to conventional rims in the customary fashion. There is the remote possibility that players aggressively jumping up towards the goal may get fingers or even teeth entangled in the net, and thereby suffer significant pain and injury upon falling back to the floor.

DESCRIPTION OF THE PRIOR ART

This problem has led to the invention of basketball net assemblies using alternative schemes and means which can conceptually be readily installed, removed and stored for reinstallation when later required.

Qualley's U.S. Pat. No. 4,834,368, May 30, 1989, teaches a modification to the conventional net to add a flexible collar to the large end of the net, which collar, when properly oriented and installed, embraces the rim circumference and is folded over on itself and secured by sections of hook-and-eye fabric tape material. There may be significant cost to such a complex net, its appearance is unaesthetic as to a conventional net, there is the necessity for a ladder or other means to access the rim for installation and removal, and there is significant time required for the manipulation of the net assembly for installation and removal, all of which burden the utility and value of Qualley's invention for many individual users.

McGivern's U.S. Pat. No. 5,098,091, Mar. 24, 1992, teaches the use of a supplemental rim to which the net is attached, the supplemental rim then being suspended under the primary rim by means of six quick disconnect straps or fasteners which are folded over the primary rim and secured then to themselves. As with Qualley's invention, there may be significant cost to such a complex net assembly, its appearance is unaesthetic as to a conventional net, there is the necessity for a ladder or other means to access the rim for installation and removal, and there is significant time required for the manipulation of the ladder and net assembly for installation and removal, all of which burden the utility and value of McGivern's invention for many individual users.

Anderson's U.S. Pat. No. 4,903,964, Feb. 27, 1990, teaches the use of an annular, inverted, channel-shaped, rim-engaging device with slots on the lower periphery to which a net is attached. The device is lifted into position, rotationally oriented to account for the rim support, and pulled down into a pressfit engagement with the rim by use of a long lifting tool with a hook-shaped end. There may be significant cost to such a complex net assembly, there is the necessity for a long lifting tool with a hook-shaped end for installation and removal, and there is significant time required to acquire and use such a tool for installation and removal of the net assembly, all of which burden the utility and value of Anderson's invention for many individual users.

McArdle's U.S. Pat. No. 4,805,903, Feb. 21, 1989, teaches the use of a circular skirt that fits just inside the basketball rim, with an outwardly-rolled upper edge with a magnetic strip that secures it, when properly rotationally oriented for the rim support, around the top edge of the rim, a net being fastened to the lower edge of the circular skirt, and a boat hook being required to install and remove the device from the basketball rim. There is the necessity for use of a long lifting tool with a hook-shaped end for installation and removal, and there is significant time required to acquire and use such a tool for installation and removal of the net assembly, all of which burden the utility and value of McArdle's invention for many individual users.

Apo's U.S. Pat. No. 4,905,995, Mar. 6, 1990, teaches the use of a two-inch wide circular collar having an approximately ninety (90) degree outwardly-rolled flange on the upper end to rest on the top inner half of a basketball rim, and a net attached to the lower end of the collar, with the use of a long pole with protruding pins for installation and removal of the collar from the rim. There is here the necessity for a long lifting tool with protruding pins for installation and removal, there is significant time required to acquire and use such a tool for installation and removal of the net assembly, and the appearance of a two (2) inch long collar below the rim is unaesthetic as to a conventional net, all of which burden the utility and value of Apo's invention for many individual users. Apo's disclosure does, however, teach the useful idea of dislodging and recovering a net assembly by throwing a basketball up diagonally through the hoop to contact the net and lift the collar out of its seat on the rim.

The basic problem, not raised, not addressed, and not answered by the prior art, is the individual user's need for a personal solution to the problem of how to provide a transportable, quickly and easily installed and removed, aesthetically pleasing, functionally useful, temporary replacement for a worn, damaged, or missing basketball net, without the need for ladders or special tools or access to the same.

SUMMARY OF THE INVENTION

The purpose of the invention is to solve the individual user's problem of how to provide a quickly and easily installed and removed, aesthetically pleasing, functionally useful, temporary replacement for a worn, damaged, or missing basketball net, without the need for ladders or special tools or access to the same.

The apparatus of the present invention in its simplest form is expected to be user-owned and is a transportable basketball net assembly that can be easily assembled and transported by the user to any court and, in accordance with the method of the invention, draped over a basketball and thrown up into position on the rim, transforming the rim temporarily into a fully functional basketball goal. Afterwards, the net assembly can be knocked down with the basketball, and taken home by the user-owner.

A necessary object of the invention is that it be a functional substitute for a conventional basket ball net properly installed on a common basketball rim. To that end, the net assembly of the invention utilizes a conventional basketball net which will interact with the basketball in the familiar fashion when installed on a common basketball rim.

A primary object of the invention is that it be easily assemblable prior to use, without tools, if not already assembled at purchase. The net assembly is composed of only two principle parts; a flanged collar and a net. The net assembly is easily assembled by hand before the first use, by assembling the net to the flanged collar. It is equally easy, if ever required, to change a net by the same general process.

Another primary object of the invention is that it be easily transportable for users including pedestrians. The net assembly remains assembled, after initial assembly, and compacts to approximately the size of a pizza box. It is not heavy, and requires no accessory tools to be transported with it.

A further primary object of the invention is that it be durable, unbreakable and long-lasting. The flanged collar of the preferred embodiment is molded of durable, unbreakable plastic, and should stand up indefinitely to normal use. A conventional basketball net will likely last far longer as part of a personally-owned, transportable net assembly than as a naked net in a permanent public, perhaps outdoor, installation.

A yet further primary object of the invention is that it be aesthetically acceptable to a majority of users. The flanged collar is short in height, due in part to the net being attached to the flange rather than the lower end of the collar as illustrated by some prior art, and it has no conspicuous attachment devices. It simply sits in place on the rim, and so is not aesthetically objectionable due to an extended collar or highly visible attaching means.

A still yet further primary object of the invention is that it be configured with easily engaged and effective net attachment means that provides effective strain relief to net's attach-loop lines. The slots of the invention may simply be radially oriented slits on the outer perimeter of the flange onto which the attach-loops are hooked. The flanged collar of the preferred embodiment is configured with U-shaped slots, which are oriented with the open end directed towards the center of the flange, to which the attach-loops of the net are simply attached from above the flange as to tabs. The net is then dropped through the collar and arranged so that the attach-loop lines of the net traverse, hang across, and are supported by the uniform radius or shoulder of the transition between the flange portion and the collar portion of the flanged collar. The uniform radius or shoulder provides a degree of strain relief to the attach-loops and slots.

Optionally, holes may be provided in the flange near the slots, down through which the attach loops are passed and then hooked into the slots from below. This provides additional security and strain relief to the overall arrangement.

A principal object of the invention is that it be uniformally circular with no need to be rotationally oriented for proper placement on the rim, as is common to some of the prior art. Since the flange of the flanged collar rests flat atop the rim, the collar being contained within the rim opening, the net attached to the top of the flange and disposed over the uniform radius or shoulder and down the inner wall of the collar, there is no protruding element to interfere with conventional rim support structure. Hence there is no rotational orientation requirement for the net assembly of this invention.

Another principal object of the invention is that it have an upper surface texture conducive to positive contact and good interaction with a moving basketball. To this end, the upper surface of the flange of the flanged collar, where it will most often and most likely contact the moving basketball, may be configured with a grainy, textured finish, rather than the smooth, slippery finish commonly achievable with items of molded manufacture.

A further principal object of the invention is that it have structure conducive to a slight fricion fit between the rim and the flanged collar to promote a firm, non-bouncing, non-sliding contact with the rim. To this end, the collar may be formed with or have attached to it slight protrusions. Alternatively or in combination, any or portions of the surfaces of the flanged collar likely to be in contact with the rim when properly installed may be configured with a layer of thin foam or rubber or other resilient, non-slip, slightly compressible, gripping sort of padding or small pads. The underside surfaces of the flanged collar likely to be in contact with the rim include the lower surface or underside of the flange, the inside surface of the uniform radius or shoulder, and the outside surface of the collar.

A yet further principal object of the invention is that it be easily manufacturable at low cost. The simplicity of the flanged collar lends itself to manufacture as a one-piece molded item. The balance of the net assembly is simple and inexpensive. There are no special accessories required.

A still yet further principal object of the invention is that it have a quick and simple means for installation and removal that requires no ladders or special tools, none of the risk associated with ladders or special tools, and no additional people. To this end, field testing has demonstrated that the length and mass of a conventional basketball net and it's various lines is sufficient to be gathered and held to one side to close the lower end of the net so that the net assembly can be inverted and disposed over the basketball, then thrown up with the basketball into position on the rim.

When the flanged collar lodges into position and is supported by the rim, the falling ball opens the net, falling on through. The net is then in condition for normal operation. When the activity is over, the net assembly is easily removed and recovered by throwing the ball diagonally up through the hoop, contacting the net or the edge of the flanged collar or both, dislodging the net assembly to fall to the waiting owner below.

The flanged collar may be of sufficient thickness, stiffness and strength to support and retain the net assembly in its working position on the rim during normal play while still being deformable and pliable enough, or configured with one or more pre-engineered weak points about its circumference, such that a heavier than normal downward force on the net may cause the flanged collar to deform and be pulled through the rim; the flanged collar being resilient enough to then resume it's original shape.

DESCRIPTION OF THE PREFERRED EMBODIMENT

Figure 1:
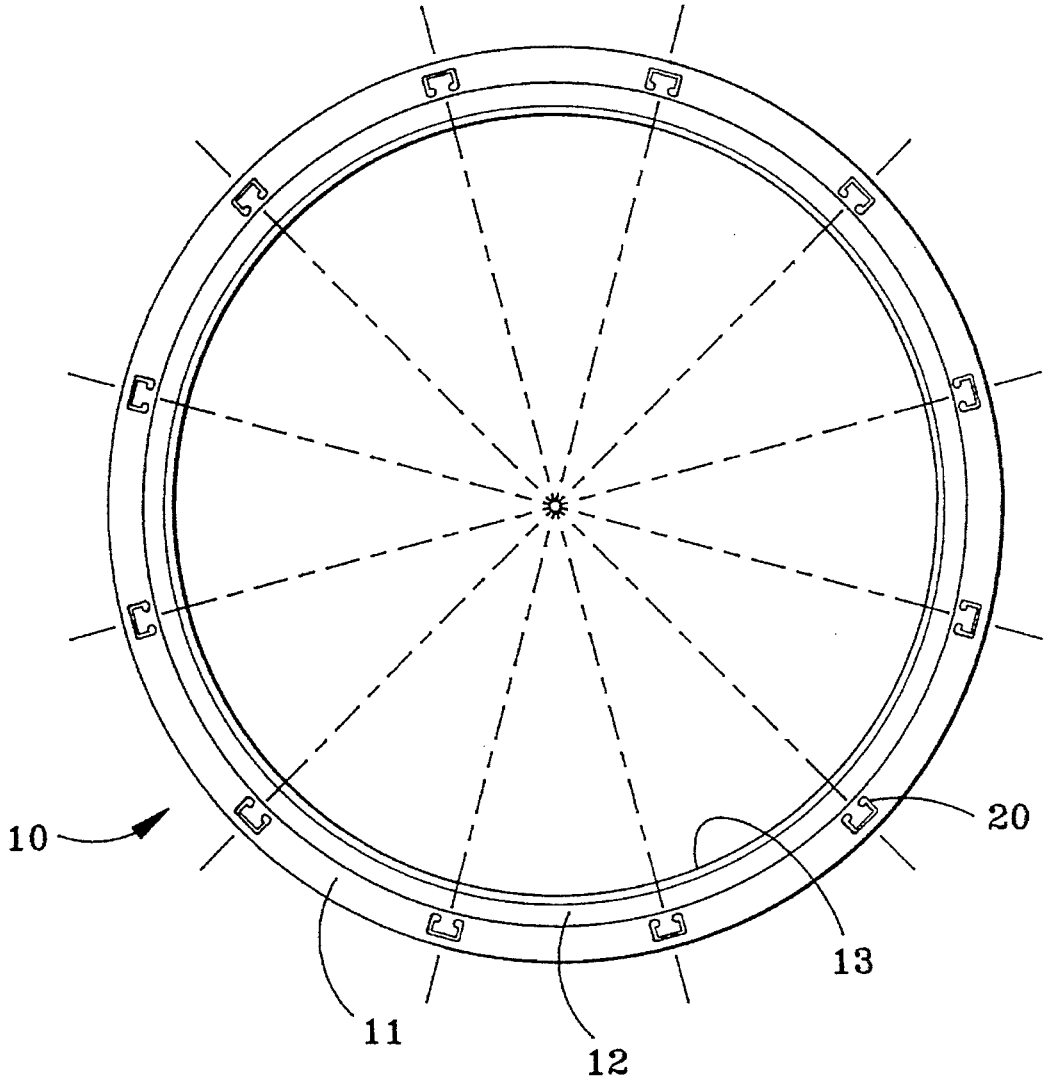
FIG. 1 is a top view of the preferred embodiment of the flanged collar of the net assembly, illustrating the U-shaped slots uniformally spaced around the circumference on the flange of the flanged collar, to which the attach-loops of the basketball net are attached.

To those of ordinary skill in the art, the apparatus and methods of the present invention admit of variations.

As an example, the design size of the flanged collar can be varied to fit any size hoop or rim used in any game or activity wherein a netted hoop is required.

As another example: the net used in the net assembly can be any of a broad range of sizes and designs, of open or closed weave, open or closed-ended, and so on, as appropriate to the activity and the user's desire.

As a further example: the flange of the flanged collar may be of sufficient thickness, stiffness and strength to support and retain the net assembly in its working position on the rim during normal play, and be deformable enough and pliable enough, or configured with one or more pre-engineered weak points about its circumference, such that a significantly heavier than normal downward force on the net will cause the flanged collar to deform and be pulled through the rim, and be resilient enough to then resume it's original shape. The pre-engineered weak spots may be radially oriented shallow grooves on the top or the bottom of the flange of the flanged collar, or radially oriented slots in the flange of the flanged collar disbursed between the net attachment points, or other modifications to a uniform flanged collar designed to provide the pull-through capability.

As a yet further example: the upper surface texture can be varied by design or by modification to suit the type of ball being used and the activity involved.

As a still yet further example: the flanged collar may be designed or modified to accommodate other features such as the attachment of a practice grid to prevent the passage of balls through the rim, increasing the incidence of rebounds for practice, or the addition of appendages to fit or hook over the rim for greater stability.

As an illustration: any or all of the surfaces of the flanged collar likely to be in contact with the rim when the net assembly is in place may be configured or modified to include small foam pads, or some degree of padding or application of slightly compressible, non-skid, resilient material or surface treatment, for making a slight friction fit between the flanged collar and the rim, and for improving the stability and reducing any tendency of the flanged collar to bounce or slide on the rim when contacted by a moving ball. Additionally, the collar of the flanged collar may have buttons or other slight protrusions molded in or attached to the flanged collar to aid the friction fit of the flanged collar within the rim.

As a further illustration: The flanged collar may be fabricated from a variety of materials including metals and different plastics. The flanged collar may be molded, machined, or stamped or otherwise manufactured.

As a yet further illustration: the temporary closing of the net may be accomplished by a simple gathering of the small end of the net and holding it to one side so as to contain the ball or other carrying object from passing through the net prematurely when the net assembly is disposed over the ball and thrown into the rim.

The apparatus of the invention is a net assembly composed of two principal elements: a circular flanged collar and a net. The methods of the invention pertain to the assembling of the net assembly, particularly to the attaching of the net to the flanged collar, and to the installation of the net assembly into position on the rim. The following is merely a description of the preferred embodiment of the apparatus and methodology of the invention.

The preferred embodiment of the circular flanged collar has a flanged portion, around the circumference of which are disposed a series of uniformally spaced slots for attaching a net, the flange of the flanged collar being constructed to adequately support the net assembly but configured with pre-engineered weak points interdispersed with the net attachment slots. The pre-engineered weak points are radially oriented shallow grooves in the lower surface of the flange. The inner diameter of the flange transitions downward via a uniform radius or shoulder, into a short collar of slightly smaller diameter. The flange is of a suitable size to sit atop a basketball rim. The collar is of a suitable size to fit easily within the mouth of the rim. The flanged collar is a one-piece unit molded of durable plastic. The slots in the flange for attaching the net are U-shaped, the open end of the U oriented towards the center of the flange. Small foam pads are uniformally spaced and adhered to the lower surface of the flange and to the outer surface of the collar The preferred embodiment of the net is simply a conventional basketball net, commonly available at any sporting goods store. The preferred method of assembly has the attach-loops of the net attached from above the flange, hooked around the center of the U-shaped slot as to a tab, the net then being disposed down through the center of the collar so as to have the attach-loops traversing or lying over and being supported by the uniform radius or shoulder for stress relief, hence running down the inside wall of the collar and connecting to other lines of the net.

Reference is now made to the drawings which illustrate pictorially the various elements of the preferred embodiment.

Flanged collar 10 has a flange 11, around the circumference of which are disposed a plurality of uniformally spaced slots 20, for attaching attach-loops 31, of net 30. Radially oriented grooves 60 are equally spaced around the lower surface of flange 11. The inner diameter of flange 11 transitions downward, via a uniform radius 12, into collar 13. Flanged collar 10 optionally has grainy textured upper surface 14. Flange 11 is of a suitable size to sit atop basketball rim 50. Collar 13 is of a suitable size to fit easily within mouth of rim 50. Flanged collar 10 is a one-piece unit molded of durable plastic. Small foam pads 15 are uniformally spaced around and adhered to the underside of flange 11 and uniformally spaced around and adhered to the outer surface of collar 13. Slots 20, in flange 11, are U-shaped, the open end oriented towards the center of flange 11.

Net 30 is simply a conventional nylon basketball net. Attach-loops 31 attach from above flange 11, around the center of U-shaped slots 20. Net 30 is then disposed down through the center of collar 13; attach-loops 31 traversing or lying over and being supported by the uniform radius 12 for stress relief, hence running down inside wall of collar 13, hence connecting to other lines 32 of net 30.

Figure 5:
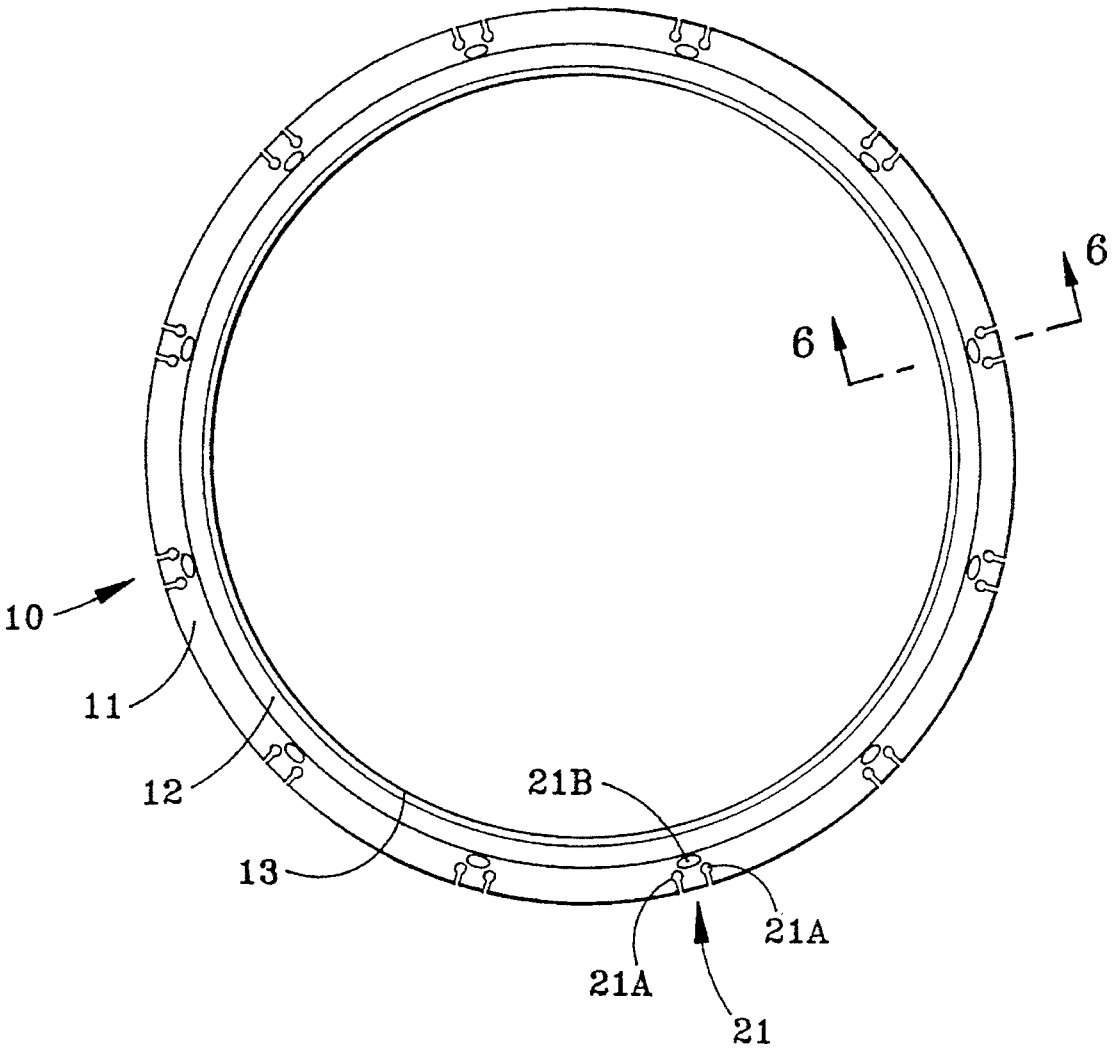
FIG. 5 is a top view of an embodiment of the flanged collar illustrating pairs of slots and nearby holes uniformally spaced around the circumference of the flange to which attach-loops of the net will be attached.
Figure 6:
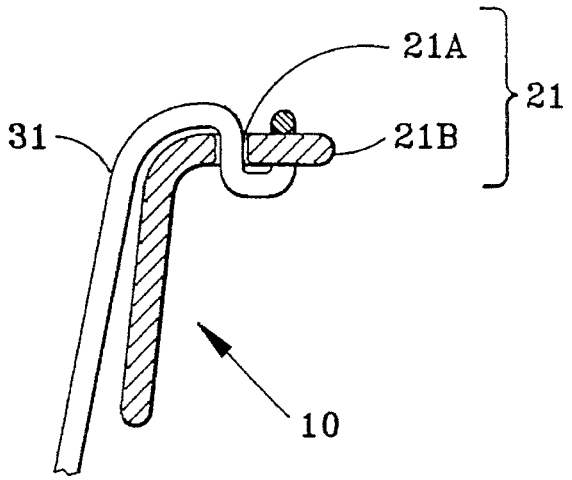
FIG. 6 is a partial cross-sectional view of the embodiment of the flanged collar of FIG. 5, illustrating the attach-loop running up the interior of the collar wall from the net, traversing the uniform radius or shoulder, up onto the flange, hence passing down through a hole and hence hooked to a pair of slots as to a tab.

As depicted by FIGS. 5 and 6, uniformally dispersed pairs of slots 21A and co-located holes 21B together form net attachment means 21, an alternative to slots 20 for securing attach-loops 31 of net 30 to flanged collar 10.

I claim:

1. A transportable basketball net assembly for use on a basketball rim, said net assembly comprising:

a circular flanged collar having a diameter and including a plurality of net attachment means uniformly spaced around a circumference of said circular flanged collar and disposed on a flange of said flanged collar, an inner diameter of said flange transitioning via a uniform radius downward into a collar of slightly smaller diameter, said flange sized to a rest on top of said rim, said collar diameter sized to fit easily within a mouth of said rim; and a basketball net, attach-loops of said net attached to said net attachment means of said circular flanged collar, said net disposed downward within said collar, said attach-loops of said net traversing and supported for strain relief by said uniform radius of said flanged collar, a small end of said net hanging open.

2. The transportable basketball net assembly of claim 1, said flanged collar configured with resilient means for deforming sufficiently to be pulled through said rim upon application of a heavier than normal downward force on said net.

3. The transportable basketball net assembly of claim 2, said resilient means comprising said flanged collar configured with a wall thickness sufficient to support said net assembly in normal use and sufficiently deformable to be pulled through said rim upon said application of said heavier than normal downward force.

4. The transportable basketball net assembly of claim 2, said resilient means comprising a multiplicity of pre-engineered weak points interdispersed on said flange.

5. The transportable basketball net assembly of claim 4, said weak points comprising radially oriented grooves on a lower surface of said flange.

6. The transportable basketball net assembly of claim 5, wherein:

said net attachment means comprising slots, said slots being configured in a U-shape and each used as a tab to which said attach-loops are attachable;

said flanged collar further comprising a grainy, textured finish on at least an upper surface of said flange; and said flanged collar configured with means for making a friction fit between said net assembly and said rim, said means for making a friction fit comprising at least one resilient, slightly compressible pad affixed in at least one place on surface normally in contact with said rim.

7. The transportable basketball net assembly of claim 2 wherein:

said net attachment means comprising slots, said slots being configured in a U-shape and each used as a tab to which said attach-loops are attachable; and said flanged collar configured with means for making a friction fit between said net assembly and said rim.

8. The transportable basketball net assembly of claim 1, said net attachment means comprising slots, said slots being configured in a U-shape and each used as a tab to which said attach-loops are attachable.

9. The transportable basketball net assembly of claim 1, said flanged collar further comprising a grainy, textured finish on at least an upper surface of said flange.

10. The transportable basketball net assembly of claim 1, said flanged collar configured with means for making a friction fit between said net assembly and said rim.

11. The transportable basketball net assembly of claim 10, said means for making a friction fit comprising at least one resilient, slightly compressible pad affixed in at least one place on surface normally in contact with said rim.

12. A method for assembling a transportable basketball net assembly for temporary installation and use on a basketball rim, said method comprising:

attaching of attach-loops of large end of a basketball net to a plurality of net attachment means uniformally spaced around a circumference and disposed on a face of a flange of a flanged collar, wherein an inner diameter of said flange transitions via a uniform radius downward into a short collar of slightly smaller diameter, said flange sized to rest on top of said rim, said collar sized to fit easily within mouth of said rim;

disposing of said net downward within said collar; and arranging of said attach-loops to traverse and be supported for strain relief by said uniform radius, a lower end of said net thus hanging open.

13. The method of claim 12, said flanged collar is configured with resilient means for deforming sufficiently to be pulled through said rim upon application of a heavier than normal downward force on said net.

14. The method of claim 13, said net attachment means comprising slots, said slots being configured in a U-shape and used as a tab to which said attach-loops are attachable.

15. The method of claim 14, said flanged collar having means for making a friction fit between said net assembly and said rim.

16. The method of claim 15, said means for making a friction fit comprising at least one resilient, slightly compressible pad affixed in at least one place on a surface normally in contact with said rim.

17. A method for installing a basketball net on a basketball rim, said method comprising:

attaching of attach-loops of said net to a flanged collar, a flange of said flanged collar sized to rest on top of said rim, a collar of said flanged collar sized to fit easily within a mouth of said rim;

closing temporarily of small end of said net;

inverting and disposing of said net and said flanged collar over a basketball; and throwing of said basketball up from outside said rim so as to fall down through said rim, thereby depositing said flanged collar and said net into position on said rim.

18. The method of claim 17, said flanged collar configured with resilient means for deforming sufficiently to be pulled through said rim upon application of a heavier than normal downward force on said net.

19. The method of claim 18, said net attachment means comprising slots, said slots being configured in a U-shape and used as a tab to which said attach-loops are attachable.

20. The method of claim 19, said flanged collar configured with means for making a friction fit between said net assembly and said rim.

* * * * *

UNITED STATES PATENT AND TRADEMARK OFFICE

CERTIFICATE OF CORRECTION

PATENT NO. :5,484,144

DATED :January 16, 1996

INVENTOR(S) :St Onge

Figure 2:
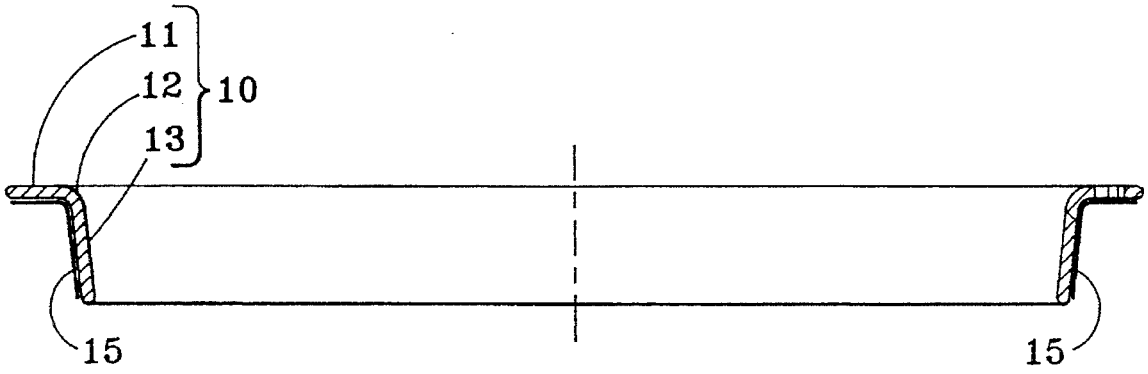
FIG. 2 is a cross-sectional side view of the flanged collar of the net assembly, illustrating the transition, via the uniform radius or shoulder, of the flange into the collar, and two of a multiplicity of resilient, slightly compressible foam pads on the surface normally in contact with the basketball rim.
Figure 3:
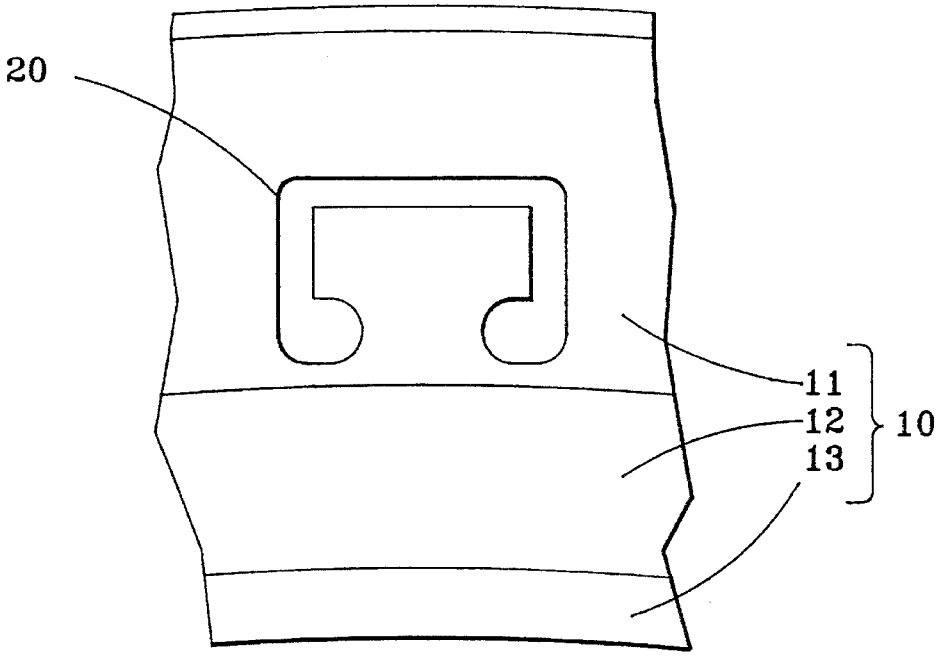
FIG. 3 is a fragmented top view of the preferred embodiment of the flanged collar, illustrating a U-shaped slot to which an attach-loop of the net is attachable as to a tab.
Figure 4:
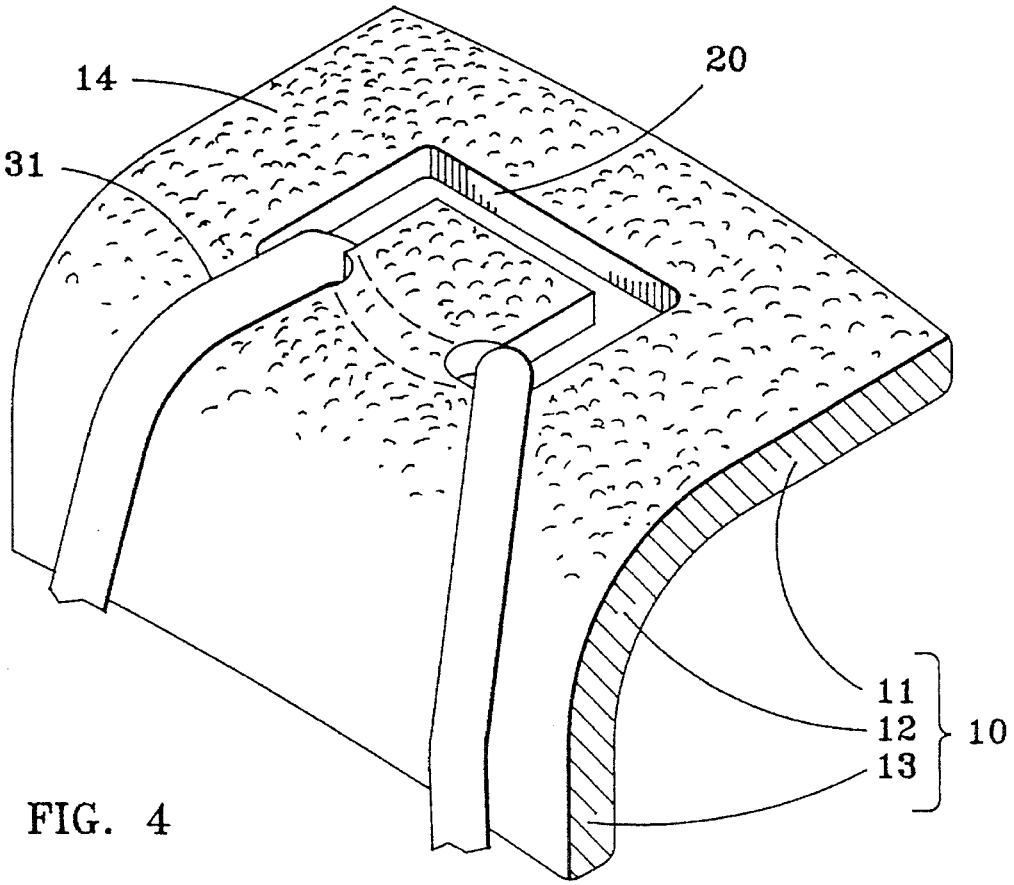
FIG. 4 is a fragmented perspective view of a section of the preferred embodiment of the flanged collar with a grainy, textured finish on the upper surface of the flange, and a U-shaped slot, illustrating the preferred method of attaching an attach-loop of the net to the slot as to a tab, hence traversing or lying down over the uniform radius or shoulder, hence hanging down within the collar and further connected to the lines of the net.

It is certified that error appears in the above-indentified patent and that said Letters Patent is hereby corrected as shown below: In the drawing on sheet 1, replace Fig. 2, with the following Fig. 2:

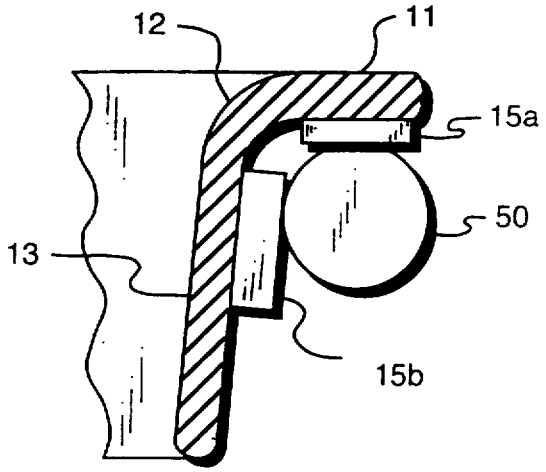

FIG. 2

UNITED STATES PATENT AND TRADEMARK OFFICE

CERTIFICATE OF CORRECTION

PATENT NO. : 5,484,144

DATED : JANUARY 16, 1996

INVENTOR(S) : St Onge

Figure 7:
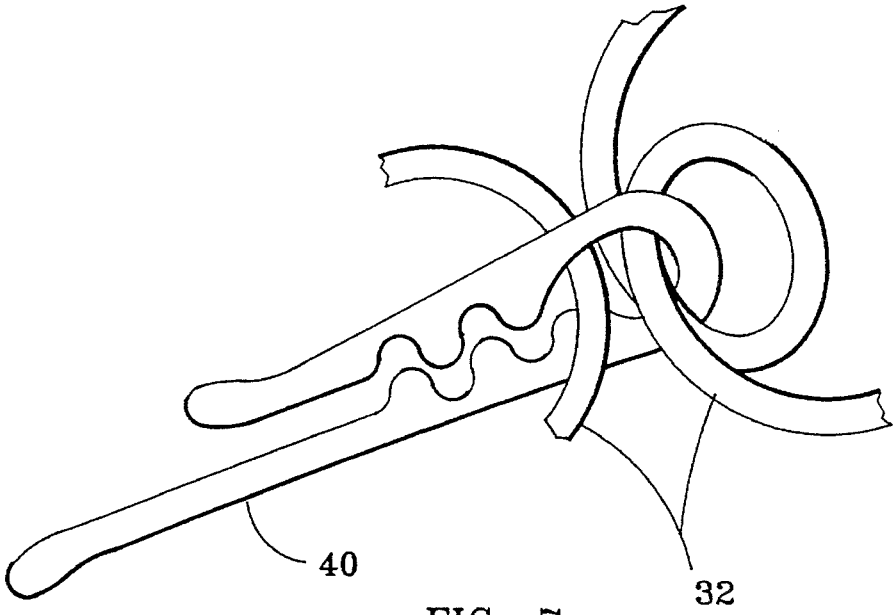
FIG. 7 is a bottom view of a flanged collar illustrating radially oriented grooves evenly distributed around the lower surface of the flange as one embodiment of pre-engineered weak points which facilitate a pull-through-the-rim capability upon the application of excessive downward force on the net.

It is certified that error appears in the above-indentified patent and that said Letters Patent is hereby corrected as shown below: In the drawing on sheet 4, replace Fig. 7, with the following Fig. 7:

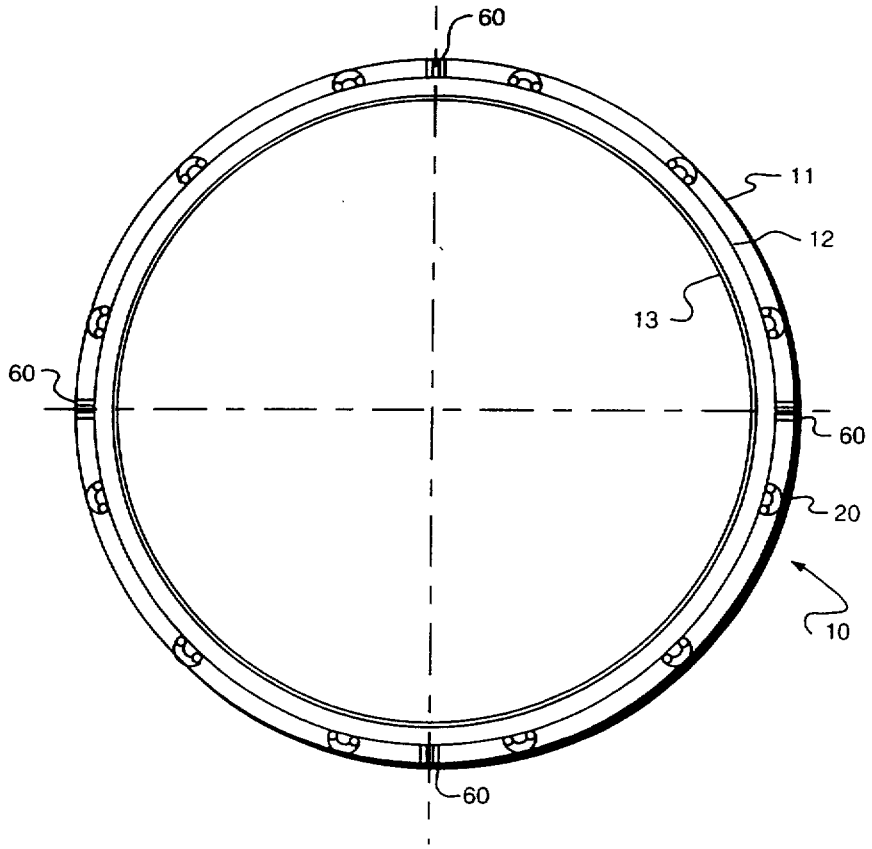

FIG. 7

UNITED STATES PATENT AND TRADEMARK OFFICE

CERTIFICATE OF CORRECTION

PATENT NO. : 5,484,144

DATED : January 16, 1996

INVENTOR(S) : St Onge

Figure 8:
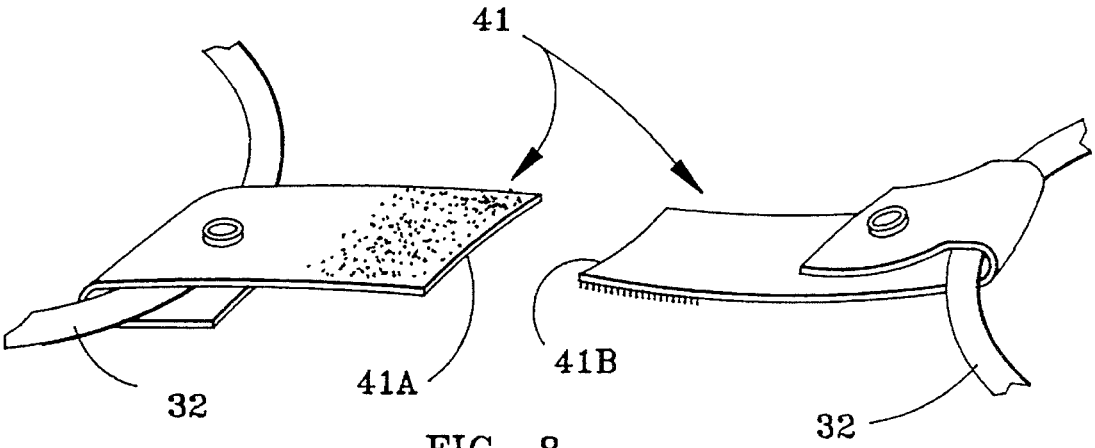
FIG. 8 is a side elevation of the flanged collar of FIG. 7, illustrating the placement of the radially oriented grooves in the flange of the flanged collar.

It is certified that error appears in the above-indentified patent and that said Letters Patent is hereby corrected as shown below: In the drawing on sheet 4, replace Fig. 8, with the following Fig. 8:

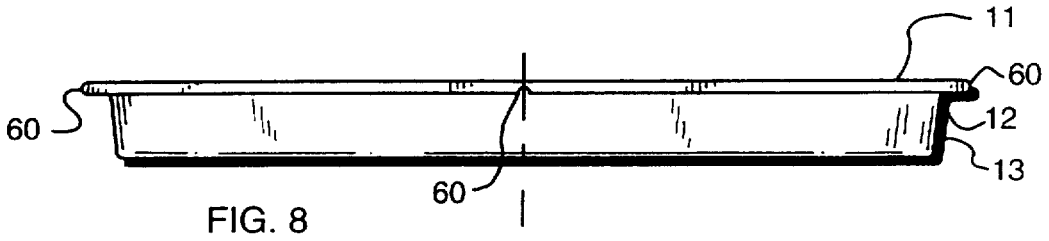

FIG. 8

UNITED STATES PATENT AND TRADEMARK OFFICE

CERTIFICATE OF CORRECTION

PATENT NO. :5,484,144

DATED :January 16, 1996

INVENTOR(S) :St Onge

Figure 9:
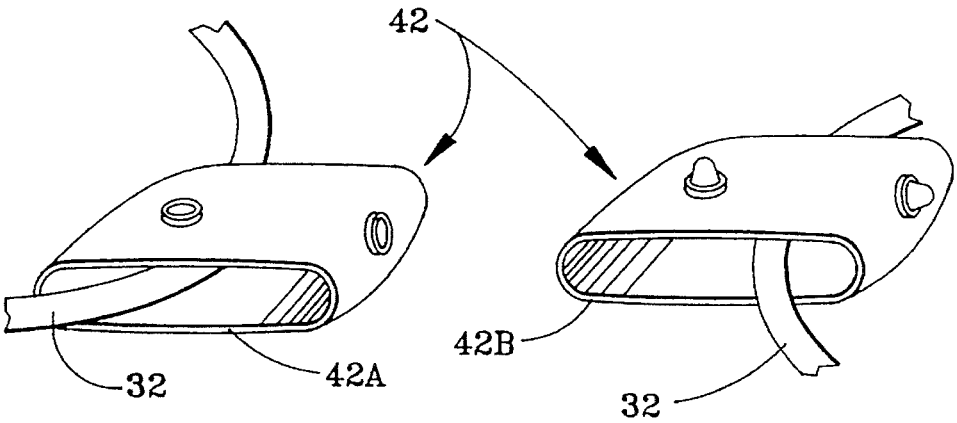
FIG. 9 is a partial close up of the side elevation of FIG. 8 illustrating the approximate scope of the radially oriented grooves in the lower surface of the flange of the flanged collar.
Figure 10:
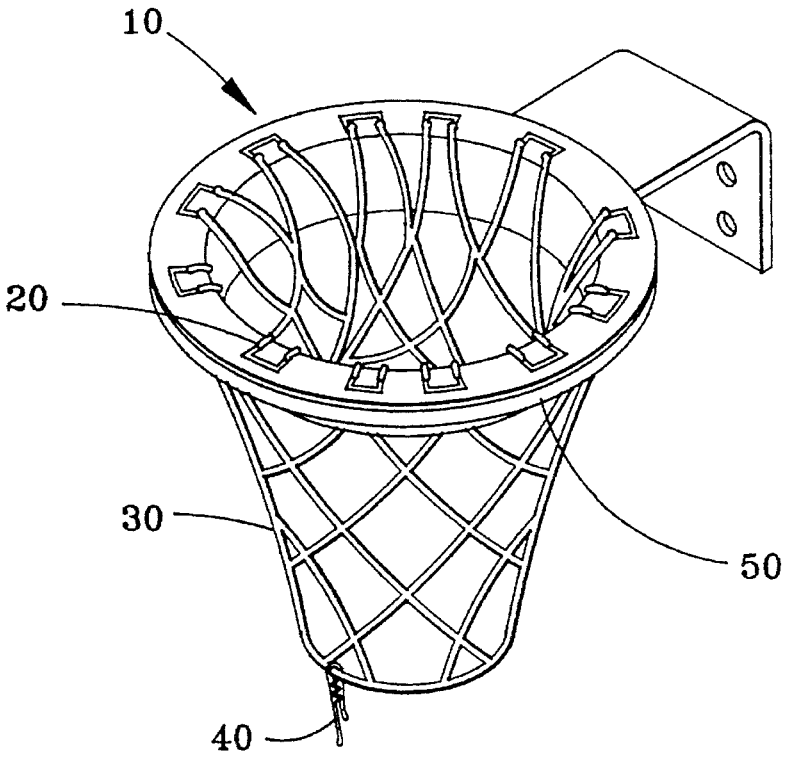
FIG. 10 is a perspective view of the net assembly installed on a basketball rim, illustrating the general relationship of the two principal parts of the net assembly as assembled and installed for its intended use.
Figure 11:
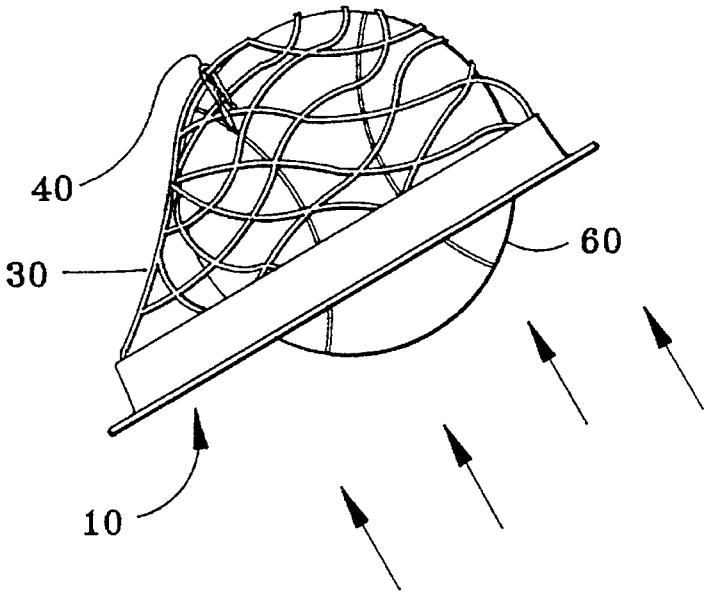
FIG. 11 is a side view of the net assembly and basketball being thrown up together, illustrating the method of the invention whereby the lower end of the net is gathered and held to one side as the net assembly is inverted and disposed over the supporting basketball, the ball and net assembly then thrown up to fall onto the rim, the net then opening under the weight of the falling ball.
Figure 12:
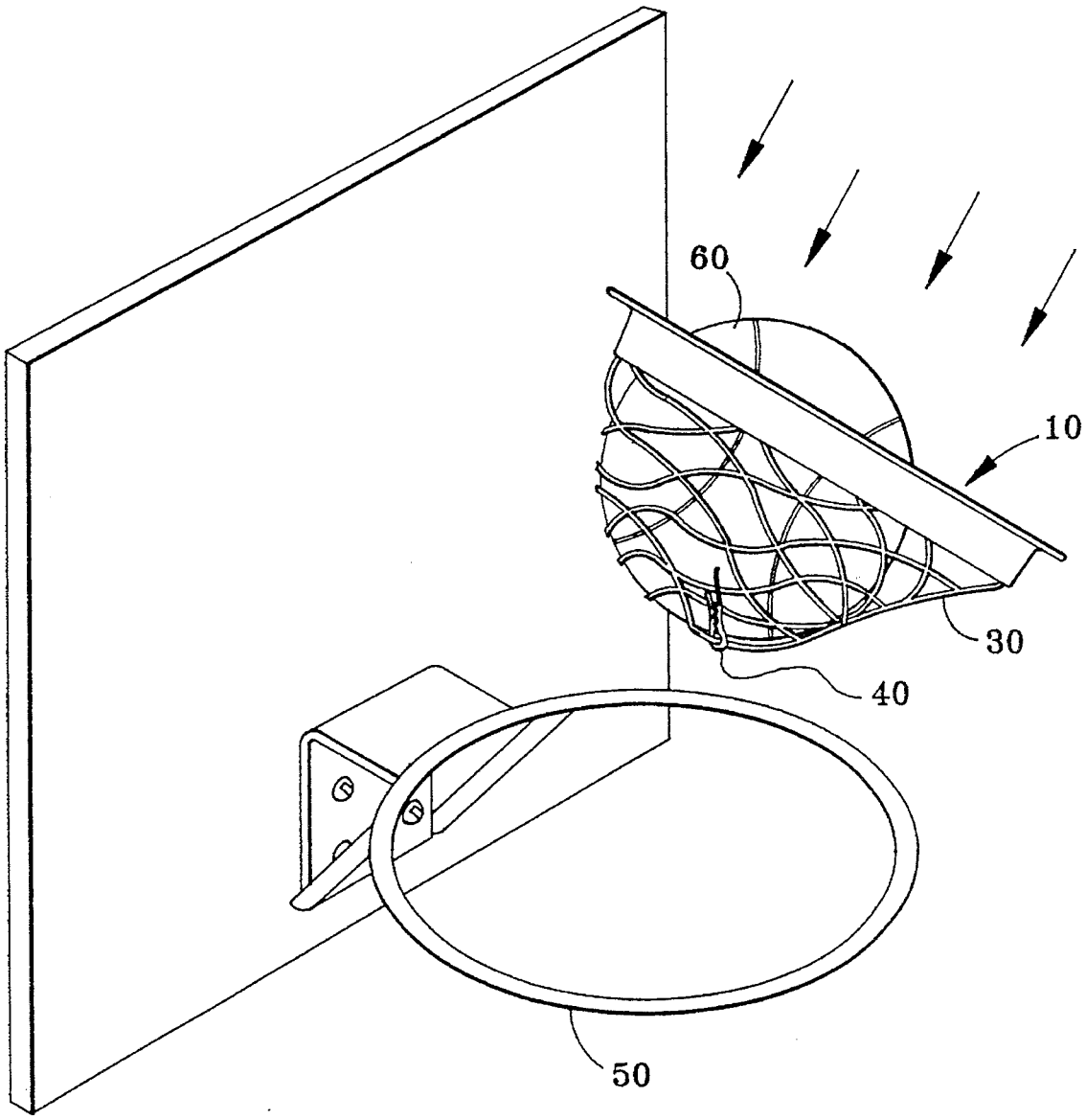
FIG. 12 is a side view of the net assembly and basketball, having been thrown as in FIG. 11, now falling towards the rim.

It is certified that error appears in the above-indentified patent and that said Letters Patent is hereby corrected as shown below: In the drawing on sheet 4, replace Fig. 9, with the following Fig. 9:

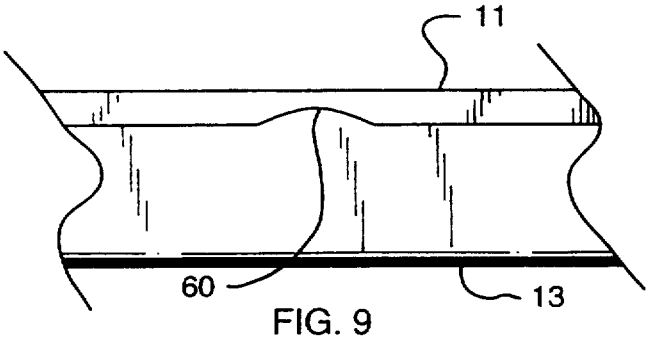

FIG. 9

Signed and Sealed this

Fifteenth Day of October, 1996

Bruce Lehman

*Attest:*

BRUCE LEHMAN

*Attesting Officer*

*Commissioner of Patents and Trademarks*